US010004965B1

(12) United States Patent
Page

(10) Patent No.: US 10,004,965 B1
(45) Date of Patent: Jun. 26, 2018

(54) PORTABLE PITCHER'S TRAINING SYSTEM

(71) Applicant: Dallas E. Page, Eugene, OR (US)

(72) Inventor: Dallas E. Page, Eugene, OR (US)

( * ) Notice: Subject to any disclaimer, the term of this patent is extended or adjusted under 35 U.S.C. 154(b) by 0 days. days.

(21) Appl. No.: 14/545,570

(22) Filed: May 22, 2015

Related U.S. Application Data

(60) Provisional application No. 61/997,162, filed on May 23, 2014.

(51) Int. Cl.
*A63B 69/00* (2006.01)

(52) U.S. Cl.
CPC .. *A63B 69/0002* (2013.01); *A63B 2069/0006* (2013.01); *A63B 2208/0204* (2013.01)

(58) Field of Classification Search
CPC ..... A63B 69/0002; A63B 2069/0004–2069/0006; A63B 69/0075; A63B 63/00
USPC ..... 473/451, 454–456, 417, 423
See application file for complete search history.

(56) References Cited

U.S. PATENT DOCUMENTS 2,964,316 A * 12/1960 Rose ..... A63B 69/0002 473/454
3,633,909 A * 1/1972 Doynow ..... A63B 69/0002 473/454
4,473,227 A * 9/1984 Klaus ..... A63B 63/00 273/DIG. 30
4,819,937 A * 4/1989 Gordon ..... A63B 69/0075 473/417
5,035,424 A * 7/1991 Liao ..... A63B 69/0091 473/139
5,350,172 A * 9/1994 Garrett ..... A63B 69/0002 473/454
7,651,417 B1 * 1/2010 Sims ..... A63B 63/00 473/454
2004/0053711 A1 * 3/2004 Conradi ..... A63B 69/0002 473/454
2005/0255945 A1 * 11/2005 Green ..... A63B 69/0002 473/417
2007/0054757 A1 * 3/2007 Will ..... A63B 24/0021 473/454
2008/0248901 A1 * 10/2008 Mosier ..... A63B 24/0021 473/454

(Continued)

*Primary Examiner* — Mark Graham
(74) *Attorney, Agent, or Firm* — Robert E. Howard

(57) ABSTRACT

A system for training a pitcher to throw a softball or hardball. The system includes providing a plate the shape and size of a regulation home plate, the plate having a horizontal tubular rail member located along the front edge thereof. A plurality of elongated ball position indicator members are provided, each of the indicator members having an enlarged outer portion. Support means are provided that communicate with the rail member for supporting each of the ball position indicator members at its inner end. Each of the ball position indicator members are provided with a spring member located adjacent the support means and adapted to allow the ball position indicator member to be pushed inwardly by a pitched ball and return to its original configuration. The enlarged outer portions of the indicator members are vertically or horizontally arranged into a strike zone selected by the pitcher to be targeted during training. The distance between adjacent indicator members is selected so that a pitched ball entering the strike zone will contact at least one of the indicator members.

9 Claims, 3 Drawing Sheets

(56) References Cited

U.S. PATENT DOCUMENTS

| | | | | |
|---|---|---|---|---|
| 2011/0230282 | A1* | 9/2011 | Meltzer | A63B 63/06 473/417 |
| 2012/0052989 | A1* | 3/2012 | Bishop | A63B 63/00 473/456 |
| 2012/0172156 | A1* | 7/2012 | Schumann | A63B 69/0002 473/454 |
| 2015/0321063 | A1* | 11/2015 | Besherse | A63B 69/0002 473/454 |

* cited by examiner 110
154
152
125
122
124
156
160
164
150
120

64
66
35
65
62
60
36
34
32
35
60
56
30
36
44
40
42
60
52
50
25
22
24
54
44
20
42
40

10

PORTABLE PITCHER'S TRAINING SYSTEM

CROSS-REFERENCE TO RELATED APPLICATIONS

This application claims the benefit of U.S. Provisional Application No. 61/997,162, filed May 23, 2014, the entire contents of which are hereby incorporated by reference.

BACKGROUND OF THE INVENTION

The present invention relates to a portable baseball or softball pitcher's training device and method.

Basic pitcher training or practicing involves having a pitcher stand the standard distance in front of a home plate and throw the ball to a catcher.

It has long been recognized that it would be desirable to provide device to allow the pitcher to practice throwing the ball without having a catcher present. Many devices have been suggested to allow such practice throwing. Many are directed to simple targets, either solid or a hole, at which the pitcher aims the ball. However, throwing a ball at such a target does not allow the pitcher to deliver balls to various areas of the strike zone and obtain immediate feedback of where the ball crossed the plate.

SUMMARY OF THE INVENTION

It is an object of the present invention to provide a portable training system which allows immediate feedback to the pitcher of where a pitched ball crossed the plate by means of a strike zone indicator, and allows adjustment of the strike zone indicator to simulate either right or left handed batters and batters of various heights.

The training device of the present invention is a structure attached to the front of a pentagon-shaped plate member having the shape and size of a regulation size home plate commonly used in baseball or softball. The structure includes a horizontal tubular rail member attached to the front of the plate having a plurality of openings extending vertically there through.

In a first embodiment, an L-shaped ball position indicator support member has a tubular horizontal attachment leg and a tubular vertical target support arm. The tubular horizontal attachment leg is configured to be slipped over the left or right end of the horizontal tubular rail member. The tubular vertical target support arm has a plurality of horizontal openings extending there through and adapted to receive the threaded outer ends of a plurality of horizontal ball position indicator members.

Each ball position indicator member has a cylindrical inner portion formed of a foamed plastic material which has a length corresponding to the standard width of a home plate. The cylindrical inner portion and the threaded outer portion are connected together via a spring member. The threaded outer portion is passed through a selected opening in the vertical ball position indicator support arm and attached by means of a wing nut. A plurality of the horizontal ball position indicator members are attached to the vertical target support arm closely spaced apart with the foam inner portion occupying an area representing the strike zone of a batter of pre-selected height. The ball position indicator members can be moved up or down to change the vertical strike zone.

In use, the training device is placed in a suitable location on a practice field and a net erected behind it to catch balls thrown at it. The pitcher stands in front of the device the regulation distance of a pitcher from a home plate and pitches balls at the home plate strike zone. The ball strikes one or more of the foam inner portions of the ball position indicator members. By virtue of the spring attachment of the foam inner portion to the threaded outer portion the ball position indicator member will move and allow the ball to pass through. The pitcher can visually judge where the ball passed through the strike zone by the location of the movement of the ball position indicator member or members the pitched ball hit.

The device just described is of a configuration favored by more seasoned pitchers. For younger pitchers a second embodiment can be employed. In the second embodiment the ball position indicator members are similar to those described above with the exception that the end of the ball position indicator member opposite the foam portion is a spike. In this second embodiment the tubular vertical target support arm is eliminated and the spikes of the target members are passed through vertical openings of the horizontal tubular rail member in a location representing the strike zone.

Either embodiment of the device can also include as a first additional option of a front tubular member adjustably extending towards the pitcher onto which a vertical target member or members can be placed to allow the pitcher to judge vertical or horizontal movement of the ball as it approaches the plate.

Either embodiment of the device can further include a second additional option of vertical ball position indicator member or members placed adjacent first base to allow the pitcher to practice pitching to first base to pick off an off-base runner.

DESCRIPTION OF PREFERRED EMBODIMENTS

Figures 1, 2:
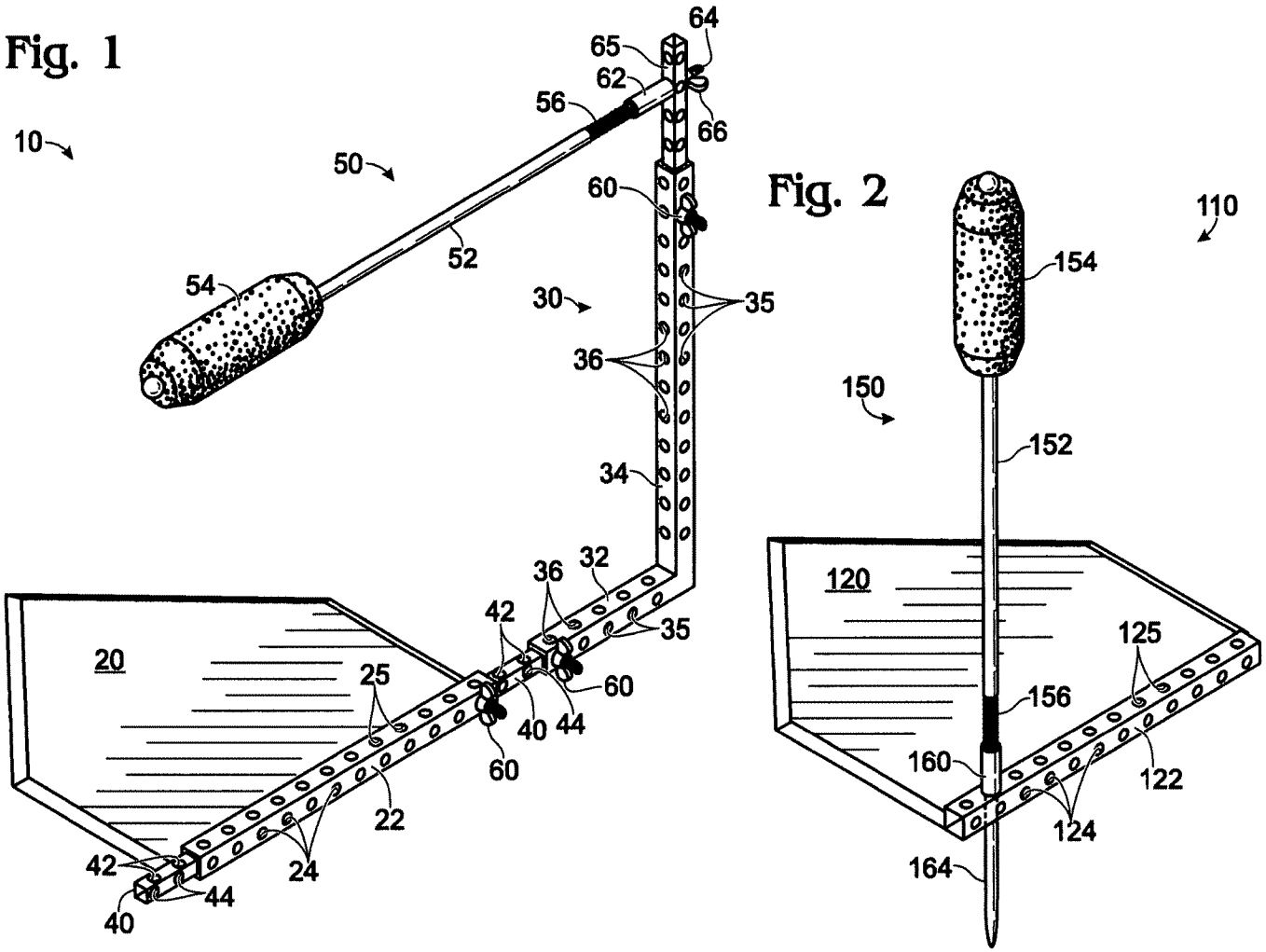
FIG. 1 is a front isometric view of a first embodiment of the portable pitcher's training device of the present invention.
FIG. 2 is a front isometric view of a second embodiment of the device.
Figure 3:
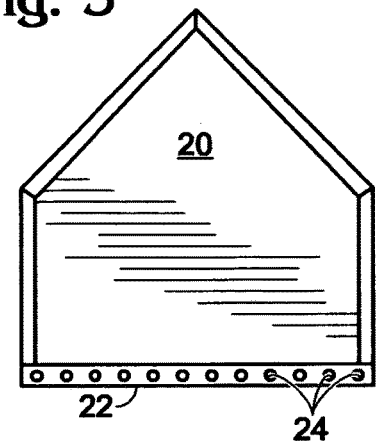
FIG. 3 is a top view of the home plate portion of the device.
Figure 4:
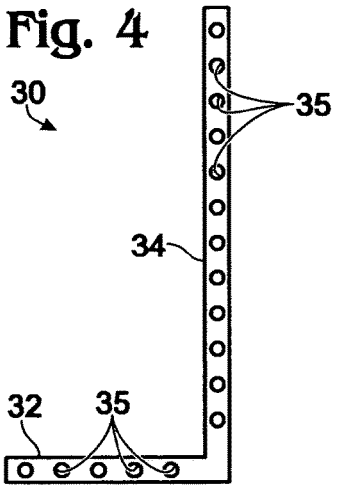
FIG. 4 is a front view of the L-shaped ball position indicator support member.
Figure 5:
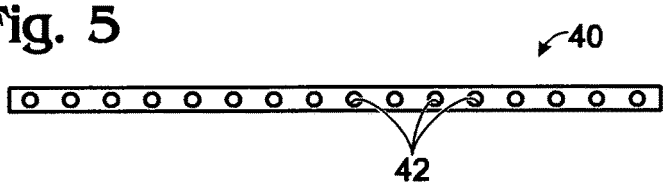
FIG. 5 is a top view of the home plate-indicator support member attachment bar.
Figure 6:
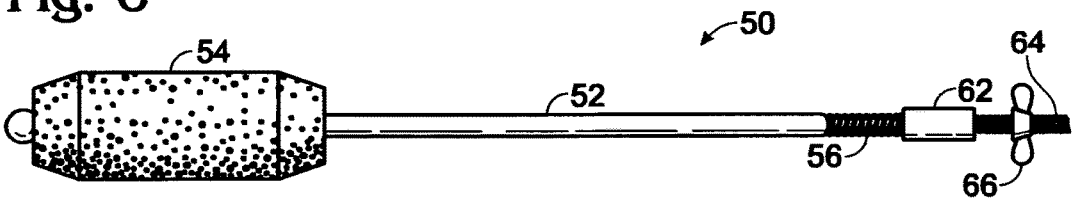
FIG. 6 is view of the ball position indicator member of a first embodiment.

FIG. 1 shows a first embodiment of the pitcher's training device 10 of the present invention.

The training device 10 includes a pentagon-shaped plate member 20 having the shape and size of a regulation size home plate commonly used in baseball or softball. The plate member 20 has a horizontal tubular rail member 22 attached to the front of the plate. Rail member 22 has a plurality of openings 24 extending horizontally there through and a plurality of openings 25 extending vertically there through.

An L-shaped ball position indicator support member 30 has a tubular horizontal attachment leg 32 and a tubular vertical support arm 34. Attachment leg 32 and tubular vertical support arm 34 have a plurality of horizontal openings 35 and 36 extending there through. A vertically adjustable tubular insert member is inserted into tubular vertical support arm 34, and after adjustment to a pre-selected position can be held in place by threaded member 64 and wing nut 66 of member 60.

A tubular attachment bar 40 is configured to be insertable into tubular rail member 22. The tubular horizontal attachment leg 32 is configured to be slipped over the left or right end of attachment bar 40. Attachment bar 40 has a plurality of vertical openings 42 and horizontal openings 44 extending there through which are spaced apart the same distance as openings 24 and 25 in tubular rail member 22. Attachment bar 40 can be moved inwardly and outwardly within rail member 22 to a desired position and held in place by a fastening member 60 such as shown in FIG. 7 or other fastening member extending through opposing openings in rail member 22 and attachment bar 40.

Ball position indicator member 50 of the first embodiment is removably attached to tubular vertical support arm 34 in a manner to be described. Ball position indicator member 50 has a central axle member 52. An enlarged cylindrical portion 54 formed of a foamed plastic material is attached to the outer end of central axle member 52. Cylindrical portion 54 has a length corresponding to the width of the strike zone the pitcher wishes to practice hitting. This width will typically range between about 40% and about 80% of the width of a standard home plate. Ball position indicator member 50 has an inner spring portion 56. Inner spring portion 56 is attached at its outer end to axle member 52 and attached at its inner end to threaded fastening member 60, as shown in detail in FIG. 7.

Figure 7:
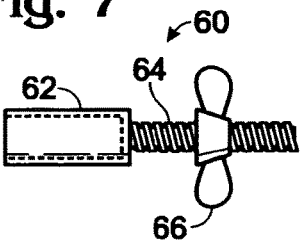
FIG. 7 is a view of a first threaded fastening member used with the first embodiment of the device.
Figure 8:
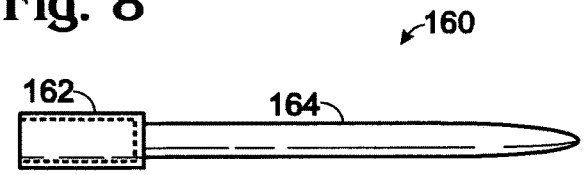
FIG. 8 is a view of a second threaded fastening member used with the second embodiment of the device.

As best seen in FIG. 7, threaded fastening member 60 includes a hollow receptor portion 62 configured to receive, and be attached to, the inner end of spring portion 56. The outer end of threaded fastening member includes a threaded bolt portion 64 adapted to receive a wing nut 66.

The threaded bolt portion 64 is passed through a selected opposed pair of openings 36 in the vertical ball position indicator support arm 30 and attached by means of wing nut 66.

Although only one horizontal ball position indicator member 50 is shown in FIG. 1 for sake of clarity, in use a plurality of the horizontal ball position indicator members 50 are attached to the vertical support arm 30. The plurality of indicator members 50 are closely spaced apart with the foam inner portion 54 occupying an area representing at least a portion of the strike zone of a batter of pre-selected height. The ball position indicator members 50 can be moved up or down on vertical support arm 30 to change the vertical strike zone, and back and forth by movement of attachment bar 40 to change the horizontal strike zone.

In use, the training device 10 is placed in a suitable location on a practice field and a net (not shown) erected behind it to catch balls thrown at it. The pitcher stands in front of the device the regulation distance of a pitcher from a home plate and pitches balls at the home plate strike zone indicated by foam portions 54 of indicator members 50. The ball strikes one or more of the foam portions 54 of the ball position indicator members 50. By virtue of spring attachment 56 of the ball position indicator member 50 will move and allow the ball to pass through. The pitcher can visually judge where the ball passed through the strike zone by the location of the movement of the ball position indicator members 50 hit by the pitched ball.

Figure 10:
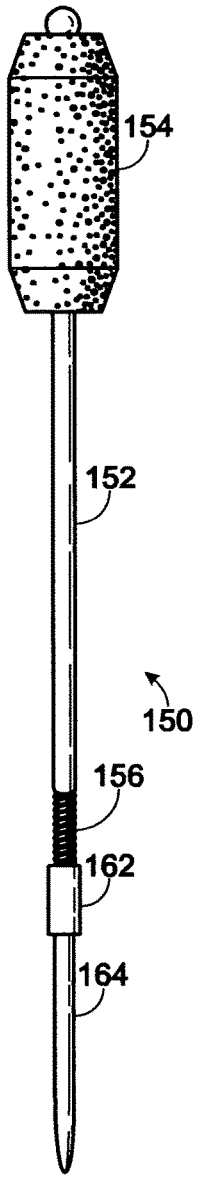
FIG. 10 is a view of the ball position indicator member of a second embodiment.

The device just described is of a configuration favored by more seasoned pitchers. For younger pitchers a second embodiment 110, shown in FIG. 2, can be employed. In the second embodiment the ball position indicator members 150, as best seen in FIG. 10 (where reference numbers indicating parts identical to those of FIG. 1 have been increased by 100) are similar to those described above with the exception that the end of the ball position indicator member 150 opposite the foam portion 154 is a spike 164. In this second embodiment the tubular vertical support arm 30 is eliminated and the spikes 164 of one or more of the indicator members 150 are passed through vertical openings 125 of the horizontal tubular rail member 122 in locations representing the strike zone, and stuck into the ground.

Figure 9:
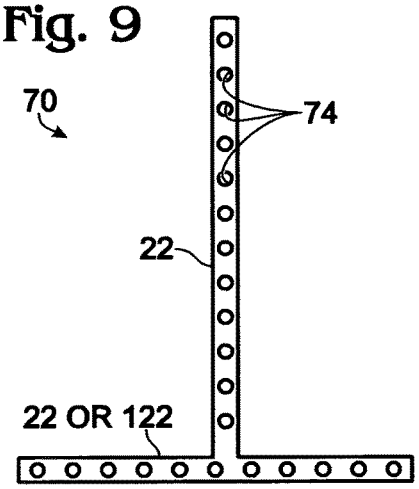
FIG. 9 is a view of a forward ball position indicator support member.

Either of the two devices 10 and 110 can also include as a first additional option of an inverted T-shaped front tubular member 70 (FIG. 9). Portion 22 or 122 of member 70 would replace horizontal tubular member 22 of the embodiment of FIG. 1 or horizontal tubular member 122 of the embodiment of FIG. 2. Front tubular member 70 includes a tubular member 72 which would lie on the ground in front of platre 20 or 120. Member 72 has a plurality of openings 74 extending there through. A vertical indicator member 150, as shown in FIG. 10, or plurality of members 150, can be placed there along by passing spikes 164 through openings 74 and into the ground, to thereby allow the pitcher to judge vertical or horizontal movement of the ball as it approaches the plate.

Figure 11:
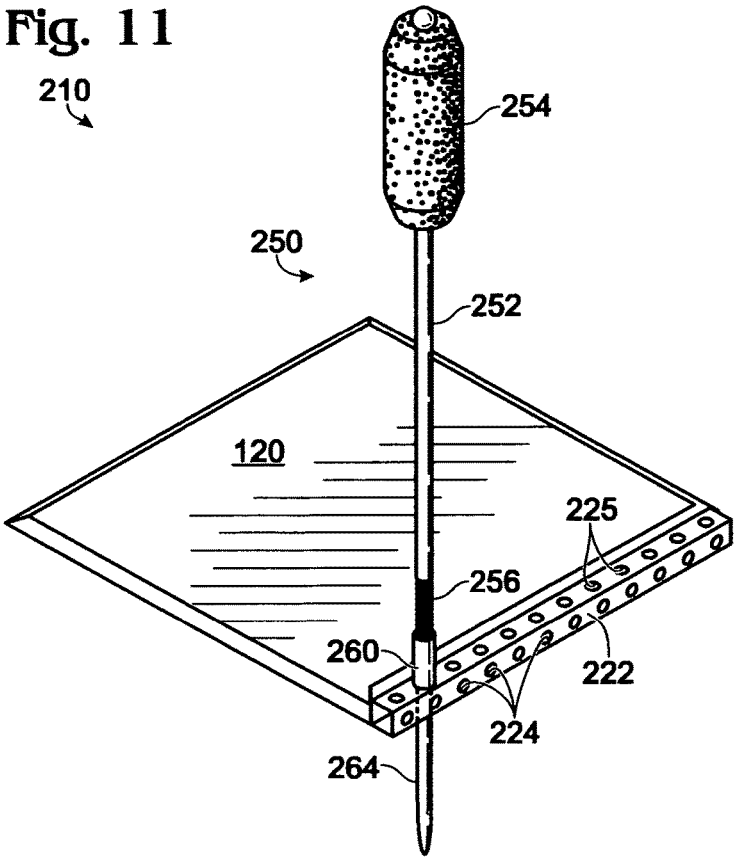
FIG. 11 is an isometric view of the ball position indicator member of the second embodiment being used in association with a base.

Either of the two devices 10 and 110 can further include a second additional option of vertical ball position indicator member or members 150 placed adjacent first base to allow the pitcher to practice pitching to first base to pick off an off-base runner. Such an embodiment 210 is shown in FIG. 11, and includes a rectangular plate 220 the size of a regulation first base, a horizontal tubular rail member 222 having a plurality of openings, 224 and 225 passing there through, and a vertical ball position indicator member 250, which is identical to ball position indicator member 150 and whose parts are identified by reference numbers identical to those of member 150 but increased by 100.

The invention includes forming a portable kit in a case which would include a plurality of the various parts sufficient to allow assemblage into any of the various embodiments described herein.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A method of training a pitcher to throw a softball or hardball comprising:

providing a plate the shape and size of a regulation home plate, said plate having a horizontal tubular rail member located along the front edge thereof, and placing said plate on the ground;

providing a plurality of elongated ball position indicator members, each of said indicator members having an enlarged portion located at its outer end, said enlarged portion having a length that is of the width or height of a strike zone;

providing ball position indicator member support means communicating with said rail member for supporting each of said ball position indicator members at its inner end; providing each of said ball position indicator members with a spring member located adjacent said ball position indicator member support means and adapted to allow said ball position indicator member to be pushed inwardly by a pitched ball hitting said enlarged portion and return to its original configuration after passage of said pitched ball;

placing said enlarged portions of said ball position indicator members into a strike zone selected to be targeted during training, said ball position indicator members being spaced apart such that a pitched ball entering said strike zone will contact said enlarged portion of at least one of said ball position indicator members; and positioning a pitcher in front of said plate a distance representing the regulation distance used in an actual hardball or softball game and having the pitcher throw the ball at the plate.

2. The method of claim 1 wherein said enlarged portion is formed of a foamed plastic material.

3. The method of claim 1 wherein a vertically disposed ball position indicator support member is adjustably attached to said tubular rail member to support said ball position indicator members in a horizontal direction.

4. The method of claim 3 wherein said vertically disposed ball position indicator support member is adjustable in both a horizontal and vertical direction.

5. The method of claim 1 wherein said horizontal tubular rail member is provided with a plurality of vertical openings.

6. The method of claim 5 wherein said ball position indicator member support means are a spike provided at the end of each of said ball position indicator members opposite said elongated outer portion and adjacent said spring member, each of said spikes being inserted through a selected one of said vertical openings in said horizontal tubular rail member in a pattern representing said strike zone and into said ground to support said ball position indicator in a vertical direction.

7. The method of claim 1 wherein said enlarged portion has a length ranging between about 40% and about 80% of the width of a standard home plate.

8. An apparatus for training a pitcher to throw a softball or hardball comprising:

a plate the shape and size of a regulation home plate, said plate having a horizontal tubular rail member located along the front edge thereof;

a plurality of elongated ball position indicator members, each of said indicator members having an enlarged portion located at its outer end, said enlarged portion having a length that is of the width or height of a selected strike zone;

a ball position indicator member support means communicating with said rail member for supporting each of said ball position indicator members at its inner end; each of said ball position indicator members having a spring member located adjacent said ball position indicator member support means and adapted to allow said ball position indicator member to be pushed inwardly by a pitched ball hitting said enlarged portion and return to its original configuration after passage of said pitched ball, said ball position indicator members being spaced apart such that a pitched ball entering said strike zone will contact the enlarged portion of at least one of said ball position indicator members.

9. The apparatus of claim 8 wherein said enlarged portion has a length ranging between about 40% and about 80% of the width of a standard home plate.

* * * * *